US008562172B2

(12) United States Patent
Chu et al.

(10) Patent No.: US 8,562,172 B2
(45) Date of Patent: Oct. 22, 2013

(54) LED TUBE END-CAP HAVING A SWITCH

(75) Inventors: Sidney Chun Kit Chu, Kowloon (HK); Chew Tong Fatt, Penang (MY)

(73) Assignee: GT Biomescilt Light Limited, Kowloon, Hong Kong, ROC (HK)

( * ) Notice: Subject to any disclaimer, the term of this patent is extended or adjusted under 35 U.S.C. 154(b) by 115 days.

(21) Appl. No.: 13/116,538

(22) Filed: May 26, 2011

(65) Prior Publication Data

US 2012/0300445 A1 Nov. 29, 2012

(51) Int. Cl.
*F21V 21/00* (2006.01)

(52) U.S. Cl.
USPC ..... 362/217.1; 362/217.13

(58) Field of Classification Search
USPC ..... 362/217.1–217.17
See application file for complete search history.

(56) References Cited

U.S. PATENT DOCUMENTS

2004/0055863 A1* 3/2004 Huang ..... 200/553
2008/0037239 A1* 2/2008 Thomas et al. ..... 362/92
2011/0149563 A1* 6/2011 Hsia et al. ..... 362/221

* cited by examiner

*Primary Examiner* — Julie Shallenberger
(74) *Attorney, Agent, or Firm* — McDermott Will & Emery LLP

(57) ABSTRACT

An end cap for a light-emitting-diode (LED) light tube includes an end cap housing having an end surface, an electric circuit and a switch for closing the electric circuit or opening the electric circuit. The switch includes a switch body having a pivot axis. The switch body is configured to pivotally move, with respect to the pivot axis, between an on-position for closing the electric circuit and an off-position for opening the electric circuit. When the switch is in the off-position, an end part of the switch body protrudes from the end surface of the end cap housing, and when the switch is in the on-position, the switch body and is substantially flush with respect to the end surface. When the switch is in the off-position, an outer surface of the switch body inclines with respect to the end surface of the end cap housing.

28 Claims, 5 Drawing Sheets

LED TUBE END-CAP HAVING A SWITCH

TECHNICAL FIELD

The present disclosure relates to an end cap for a light tube, in particular, a light emitting diode (LED) light tube. More specifically, the present disclosure relates to an end cap having a protective switch therein.

BACKGROUND

A fluorescent tube lamp 100 is one of the most widely used lighting technologies today, because fluorescent tubes are more energy efficient than incandescent lamps. FIG. 1 shows an example of a typical fluorescent tube lamp assembly. In recent times, lamps utilizing light emitting diodes have been utilized for their lower energy consumption and longer life, thereby replacing incandescent lamps, compact fluorescent lamps and fluorescent tubes.

An LED lamp 110 as a replacement for a fluorescent tube 100 typically includes several tens or hundreds of small LEDs 111 assembled on one or more printed circuit boards 115. The LED circuit board(s) is typically enclosed in a housing including a metallic housing 116 and a transparent plastic housing 117. The metallic portion 116 of the housing acts as a heat dissipater while the plastic portion 117 of the housing protects the LEDs from external environments. FIG. 2 shows an example of an LED light tube assembly.

Since the LED light tube is a replacement of the fluorescent tube, an end cap structure 112 for the LED light tube is compatible with an end cap 102 for the fluorescent tube lamp. In the fluorescent tube lamp and the LED light tube lamp, two bi-pin end caps are typically disposed on each end of the tube (see, FIGS. 1-3). In some applications, instead of bi-pin end cap 102, a single-pin end cap 103 may be utilized (see. FIG. 4).

The fluorescent tube lamp is connected to a power source by being inserted to sockets 104. The fluorescent lamp is operated by allowing electricity to pass through the fluorescent tube via the bi-pins from one end to another end of the tube. The fluorescent tube is operable regardless of the orientation of the tube when the tube is inserted into the sockets of tube holders. Typically, the fluorescent tune lamp is utilized together with a fluorescent tube ballast and a starter.

When the LED light tube is utilized to replace the fluorescent tube in a lighting fixture, the fluorescent tube ballast and starter, if any, are removed from the lighting fixture during installation of the LED light tube. The sockets are then wired directly to AC main power lines including a power line and a neutral line (i.e., a ground line).

As set forth above, the LED light tube typically includes metallic portion 116. The metallic portion of the LED light tube functions to dissipate heat away from the LEDs, a printed circuit board and a LED driver into the air through convection. However, the metallic portion 116, typically made of extruded aluminum, is electrically conductive as well. This may cause an electrical hazard when there is any leakage from an internal circuit or the AC power lines to the metallic portion.

Accordingly, it has been necessary to implement a safety device that protects the user from electrical shock in case of electricity leakage. More particularly, a safety device will be necessary when the LED light tube is being inserted into the sockets of the tube holder of a lighting fixture.

FIGS. 5 and 6 show one example of an end cap having a safety device in a known device. A cross sectional view of the internal mechanism of the conventional end-cap 201 is illustrated in FIG. 6. In this conventional example, an end-cap 201 for the LED light tube incorporates a push button switch assembly 203. This push button switch assembly 203 is activated by a spring 205 connected to switch cap 202, protruding from an end surface of the end-cap housing 204. As the LED tube is inserted into the socket, the switch cap 202 is depressed by a wall of the socket and the switch cap 202 in turn pushes the button switch 206 located underneath the switch cap 202, which are disposed inside the end-cap housing 204. The button switch 206 closes an electrically open circuit by shorting two internal electrical terminals 211, 212 via a bridging contact plate 210 disposed at the end of the push button switch 206.

The push button assembly 203 in the conventional end-cap 201 poses a few problems in practice. One problem is that the push button 203 may sometimes fail to close the circuit and may not electrically connect the terminal 211 and 212 when the end cap 202 is depressed, because of the two springs 205 and 209. More specifically, since the two springs 205 and 209 are connected in series, they may be insufficiently compressed to force the bridging contact plate 210 to be into contact with the electrical terminals 211 and 212. Thus, it has been necessary to design the end-cap 201 such that the spring force and displacement thereof consistently deliver and release the necessary force to "open" and to "close" the circuit whenever the LED light tube is inserted into or taken out of the socket 104. Failure to do so would cause unexpected turning-off of the LED light tubes or might cause electrical shock to the user.

Furthermore, when the switch cap 202 is depressed, there is friction generated between the switch cap 202 and the cap housing 204 and between a push button shank and its housing when the shank slides inside the push button assembly 203. These frictional forces often result in contact failures due to lack of connecting terminals 211 and 212.

Another problem with the conventional end cap switch is that the speed at which the bridging contact plate 210 connects electrically with the terminals 211 and 212 is generally slow, thereby causing "arcing" between the terminals. The arcing likely occurs when an air-gap between the terminals 211 and 212 is small enough for the electrical charges to build up between the bridging contact plate 210 and the terminals 211 and 212. When a sufficient potential exists between the contacts, the electricity jumps across the air-gap.

This arcing will cause the surfaces of the bridging contact plate 210 and the terminals 211 and 212 to erode and to form oxides that reduce electrical conductivity. This may result in an intermittent switch "off" problem. In a more severe situation, the arcing may also cause the terminals 211 and 212 to fuse with the contact plate 210, resulting in a permanent switch "on" position.

Accordingly, there is a need for an end cap switch for the LED tube lamps which overcomes the foregoing problems and which is more reliable and has a longer life.

SUMMARY

In order to solve the problems associated with the conventional push-button type end-cap, the present disclosure addresses one or more needs for an end-cap for the LED tube lamps which has a quick action, is more reliable and has a longer life.

In one exemplary embodiment, an end cap for a light-emitting-diode (LED) light tube includes an end cap housing having an end surface, an electric circuit and a switch for closing the electric circuit or opening the electric circuit. The switch includes a switch body and a pivot axis. The switch body is configured to pivotally move, with respect to the pivot axis, between an on-position for closing the electric circuit and an off-position for opening the electric circuit. When the switch is in the off-position, an end part of the switch body protrudes from the end surface of the end cap housing, and when the switch is in the on-position, the switch body and is substantially flush with respect to the end surface. When the switch is in the off-position, an outer surface of the switch body inclines with respect to the end surface of the end cap housing.

In the exemplary end cap, the switch may further include a first spring. The first spring is configured to make the end part of the switch body protrude from the end cap housing when the switch is in the off-position. The first spring may push the end part of the switch body when the switch is in the off-position so that the end part of the switch body protrudes from the end surface of the end cap housing. In some cases, the first spring may pull another end part of the switch body when the switch is in the off-position so that the end part of the switch body protrudes from the end surface of the end cap housing.

In the exemplary end cap, the switch further includes an extension member extending from the switch body and an arm member that is a part of the electrical circuit. The extension member is configured to move the arm member to close or to open the electrical circuit.

In the exemplary end cap, the switch further includes a contact part, and the arm member has a curved portion and a contact portion. When the switch is in the on-position, the extension member is configured to make the contact portion of the arm member to contact the contact part so as to close the electrical circuit, and when the switch is in the off-position, the extension member is configured to make the contact portion of the arm member to be detached from the contact part so as to open the electrical circuit.

The extension member may include a stud and a second spring elastically connecting the extension member and the stud. The end of the stud is configured to slide on the curved portion of the arm member.

The exemplary end cap further includes a pin for receiving electric power. The pin protrudes from the end cap housing and is connected to the electric circuit. The pin may be a bi-pin including two pins or a single pin.

The exemplary end cap may further include a switch housing for enclosing the switch. When the switch includes sub-elements such as the first spring, the extension member and/or the arm member, these sub-elements are also enclosed in the switch housing. The switch housing may have clip-on retainers, and the switch housing is retained to the end cap housing by the clip-on retainers. The switch housing may be hermetically sealed.

In another example, a light-emitting-diode (LED) light tube includes an LED light tube member on which a plurality of light emitting diodes are disposed and an end cap as set forth above. The end cap is disposed on an end of the LED light tube member. Preferably, the end caps are disposed on both ends of the LED light tube member, respectively. In the exemplary LED light tube, the switch is in the on-position when the LED light tube is inserted into a socket of a lighting fixture and the switch is in the off-position when the LED light tube is removed from the socket. The end part of the switch body is configured to be pressed to the end cap housing by the socket when the LED light tube is being inserted into the socket so that the switch body becomes substantially flush with respect to the end surface.

The end cap and LED light tube of the present disclosure, together with further objects and advantages, can be better understood by reference to the following detailed description and the accompanying drawings.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

In an exemplary end cap of the present disclosure, a quick-action snap switch with spring back action is incorporated into the end cap for LED light tubes. The spring back action keeps the switch in an "open" position when the switch cap is not depressed. This spring back action is provided by a switch cap spring.

Figure 1:
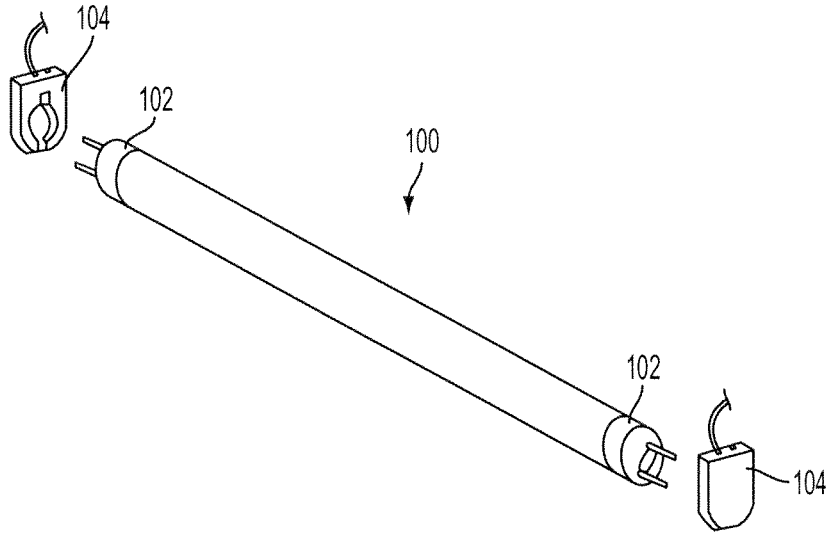
FIG. 1 is a view of a conventional fluorescent tube and the assembly thereof.
Figure 2:
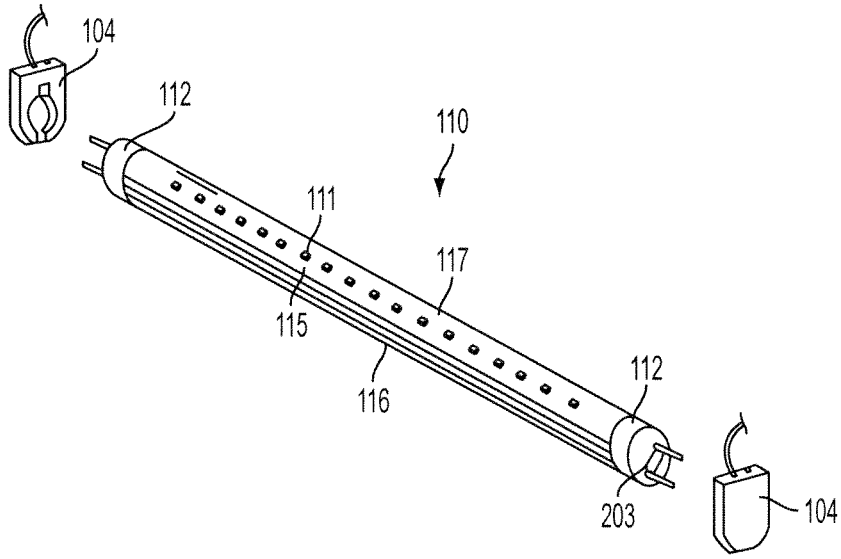
FIG. 2 is a view of a conventional LED light tube and the assembly thereof.
Figure 3:
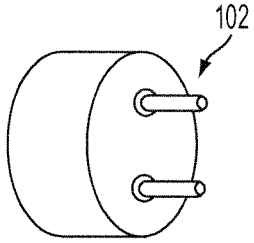
FIG. 3 is a view of a conventional end cap with bi-pin.
Figure 4:
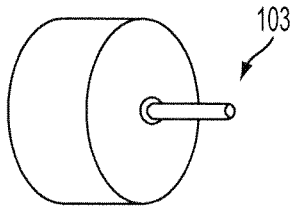
FIG. 4 is a view of a conventional end cap with a single pin.
Figure 5:
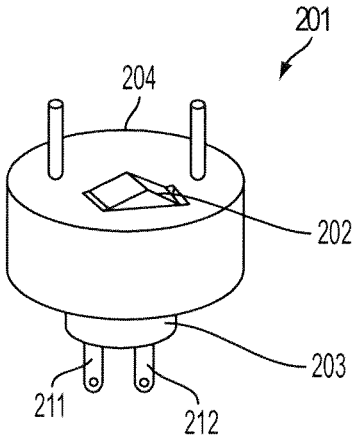
FIG. 5 PRIOR ART
FIG. 5 is a view of a conventional end cap with a push-button switch.
Figure 6:
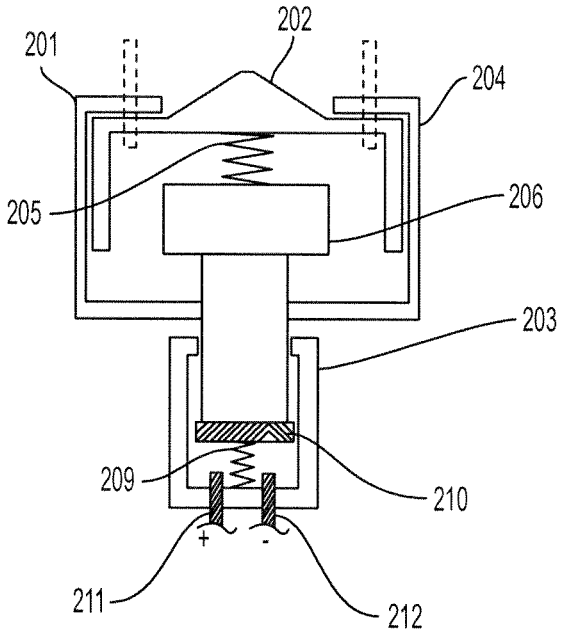
FIG. 6 PRIOR ART
FIG. 6 is a cross sectional view of the conventional end cap with a push-button switch.
Figure 7:
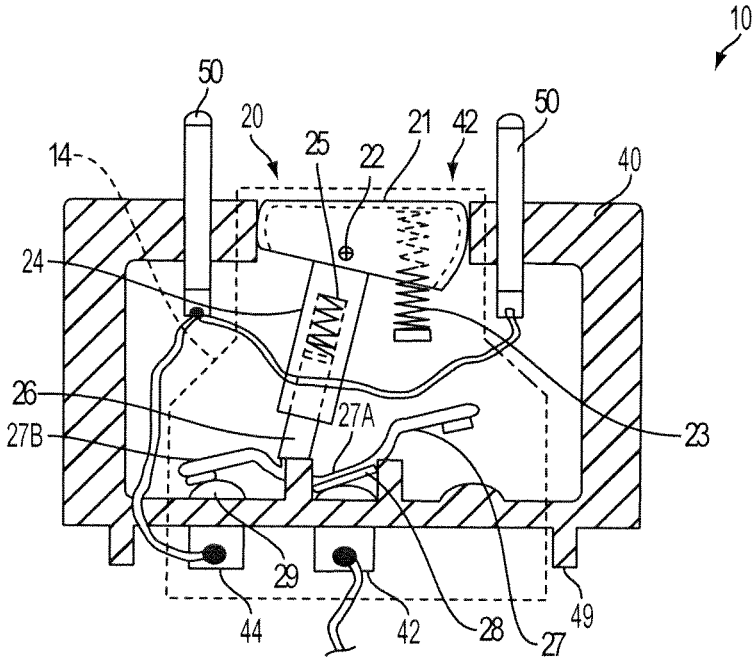
FIG. 7 is an exemplary cross sectional view of an end cap according to one embodiment of the present disclosure.
Figure 8:
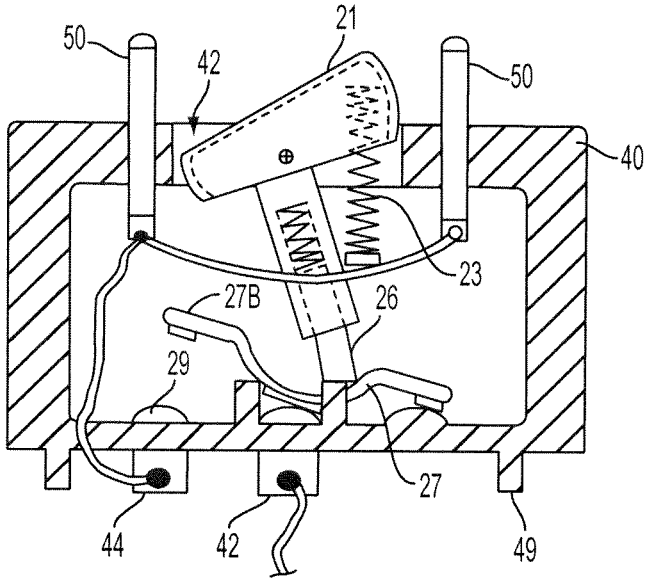
FIG. 8 is an exemplary cross sectional view of an end cap according to one embodiment of the present disclosure.

FIGS. 7 and 8 illustrate one example of the end cap 10 with a quick-action snap switch 20. The end cap 10 includes an end cap housing 40 and the switch 20. The switch 20 includes a switch body 21 which has a pivot axis 22 which is fixed to the end cap housing 40. The switch body 20 rotates around the pivot axis 22. The end cap housing 40 has an opening 42 in which the switch is disposed. A switch cap spring 23 is incorporated at one end of the switch body 21 to keep the switch in an "open" position (see, FIG. 7). The switch 20 is located on near the center of the end cap, or off-center of the end cap housing 40.

The switch 20 further includes a switch cap shank 24 extending from the switch body 21, a spring 25 and a stud 26. The switch cap shank 24 includes a tubular portion. The spring 25 and stud 26 are disposed inside the tubular portion of the switch cap shank 24. The spring 25 keeps the stud 26 extending at the end of the switch cap shank 24. The switch cap shank preferably extends from the pivot axis 22.

The switch 20 further includes a rocker arm 27. The rocker arm 27 has a curved portion 27A and a contact portion 27B. The curved portion 27A of the rocker arm 27 is disposed on a convex portion 28 (a bump) of the end cap housing so that the rocker arm can swing. The convex portion 28 works as a fulcrum and is an electric terminal electrically connecting to a terminal 42 disposed on the end cap housing 40. The rocker arm 27 is placed in a cavity with a left and right slot securing the rocker arm in place.

One end of the stud 26 is in contact with the curved portion 27A of the rocker arm 27. As shown in FIG. 7, when the switch body 21 is depressed (i.e., from "off" to "on"), the stud 26 swings from one end of the curved portion 27A of the rocker arm 27 to the other end of the curved portion 27A, thereby connecting the contact portion 27B and a contact part 29 (a bump) of the end cap housing, which is electrically connected to a terminal 44 disposed on the end cap housing 40. The terminal 44 is connected to one of the bi-pins 50 for receiving electric power from a socket, and the terminal 42 is connected to the LEDs disposed on a circuit board of the LED light tube member. Accordingly, when the switch body 21 is depressed, an electric path from the terminal 42 to the terminal 44 through the convex portion 28, the rocker arm 27 and the contact part 29, is closed, thereby supplying the electric power to the LEDs.

When the stud 26 moves from one end to another of the rocker aim 27, the moving action provides a "quick snap action" of the switch and generates a "click" sound. This "quick snap action" is advantageous because the electrical connection is quickly closed, reducing the effect of electrical arcing between the contact 27B of the rocker arm 27 and the contact part 29. The "quick snap action" also helps to reduce the erosion of the contact, as well as to minimize incidences of fusing of contacts due to a slow switching motion in the conventional end cap switch designs.

The rocker arm 27 is preferably made of a low resistance material, for example copper. The contact portion 27B of the rocker arm 27 is preferably made of for example, copper alloys (e.g., beryllium copper alloy), silver (e.g., silver plating) or nickel (e.g., nickel plating). Similarly, the convex portion 28 and the contact part 29 of the housing are preferably made of, for example, copper, silver (e.g., silver plating) or nickel (e.g., nickel plating). The outermost surface of the convex portion 28 and the contact part 29 may be plated with, for example, beryllium copper.

On the other hand, when the switch body 21 is released from the depressed position (i.e., from "on" to "off"), the stud 26 swings back from the other end of the curved portion 27A of the rocker arm 27 to the one end of the curved portion 27A, thereby disconnecting the contact portion 27B and the contact part 29 of the end cap housing (see, FIG. 8). When the stud 26 moves, the moving action also provides the "quick snap action" and generates the "click" sound. This "quick snap action" reduces the effect of electrical arcing between the contact 27B and the contact part 29, and also reduces the erosion of the contact and minimizes incidences of fusing of the contacts.

The end cap 10 is attached to the end of an LED light tube and terminal 44 is electrically connected to the circuit board for providing electric power to the LEDs. The end-cap 10 may be attached to the LED light tube by one or more screws or by a bonding material including, but not limited to, epoxy or silicone.

When the LED light tube is inserted into, by a sliding motion, a socket of a lighting fixture, the switch 20 becomes depressed (i.e., in the on-position). More specifically, when the LED light tube is being inserted into the socket, the end part of the switch body 21 is pressed into the end cap housing by a wall of the socket of the lighting fixture. When the LED light tube is removed from the socket, the switch 20 transitions into the off-position.

When the LED light tube is inserted into the socket and the switch 20 is in the "on" position, the top surface of the switch body 21 is substantially flush with respect to the end surface of the end-cap housing 40. Here, "substantially flush" does not necessarily mean a perfectly flush state. Rather, the "substantially flush" refers to the state that the switch body 21 is pressed into the end cap housing 40, and does not significantly protrude from the end cap housing.

In the "off" position, the outer surface of the switch body 21 inclines with respect to the end surface of the end cap housing (see, FIG. 8) because of the force provided by the spring 23. It is noted that in this example, the spring 23 is arranged at one end of the switch body 21 and provides a "push" force to the switch body 21. It is, however, possible to arrange the spring 23 at the other end of the switch body 21, thereby providing a "pull" force for making the switch body inclined.

Figure 9:
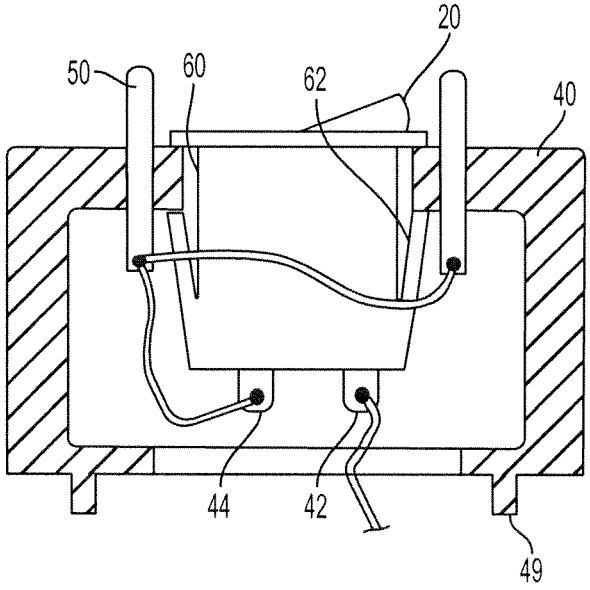
FIG. 9 is another exemplary cross sectional view of an end cap according to one embodiment of the present disclosure.

FIG. 9 shows one example of the end cap according to another embodiment of the present disclosure. In this example, the switch 20 is enclosed by a switch housing 60 except for the bi-pins. The switch housing 60 is a separate housing from the end cap housing 40 and can be inserted into an opening of the end cap housing 40. The switch housing may enclose all of the sub-elements of the switch, such as the springs 23, 25, the switch cap shank 24, the stud 26, the rocker arm 27 and the contacts 28 and 29. The switch housing includes the electrical terminals 42 and 44 disposed outside the switch housing. The terminals 42 and 44 may have screws for receiving metal wires.

The switch housing is made of plastic, and is secured to the end cap housing 40 by means of clip-on retainers 62. The clip-on retainers include "claws" disposed on the sides of the switch housing 60, thereby retaining the switch housing to the end cap housing. The switch housing may be hermetically sealed, thereby providing protection against the external environment and preventing moisture or dust from intruding. Such a sealing extends the life of the end cap.

Figure 10:
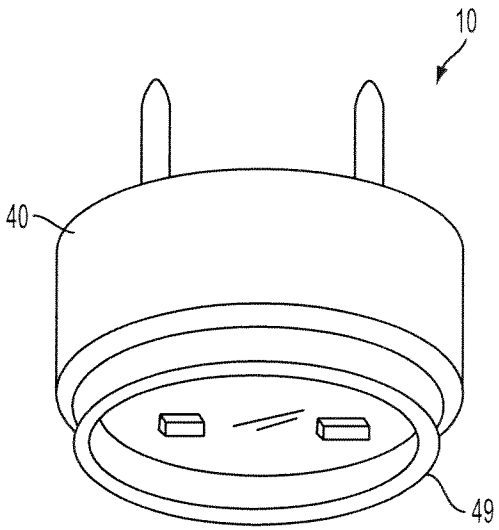
FIG. 10 is an exemplary rear view of an end cap according to one embodiment of the present disclosure.

As shown in FIG. 10, the exemplary end cap 10 further includes a ridge 49 at the bottom of the end cap housing. The ridge 49 facilitates assembling of the end-caps to the LED light tube.

One of the advantages of the end cap switch of the present structure is that the end cap switch of the present disclosure can consistently deliver and release the necessary force to "open" and to "close" the electric circuit whenever a LED light tube is inserted into or taken out of a socket of a lighting fixture. Another advantage is that the end cap switch of the present disclosure can suppress arcing or fusing of electrodes. Moreover, the end cap of the present disclosure is more reliable and has a longer life than the conventional end cap switch.

Although certain specific examples have been disclosed, it is noted that the present teachings may be embodied in other forms without departing from the spirit or essential characteristics thereof. The present examples described above are considered in all respects as illustrative and not restrictive. The patent scope is indicated by the appended claims, and all changes that come within the meaning and range of equivalency of the claims are therefore intended to be embraced therein.

We claim:

1. An end cap for a light-emitting-diode light tube, the end cap comprising:

an end cap housing having an end surface;

an electric circuit; and a switch for closing the electric circuit or opening the electric circuit, wherein:

the switch comprises a switch body having a pivot axis, the switch body is configured to pivotally move, with respect to the pivot axis, between an on-position for closing the electric circuit and an off-position for opening the electric circuit, when the switch is in the off-position, an end part of the switch body protrudes from the end surface of the end cap housing, when the switch is in the on-position, an outer surface of the switch body is substantially flush with respect to the end surface, and when the switch is not pressed, the switch is in the off-position.

2. The end cap of claim 1, wherein, when the switch is in the off-position, the outer surface of the switch body inclines with respect to the end surface of the end cap housing.

3. The end cap of claim 1, wherein:

the switch further comprises a first spring, and the first spring is configured to make the end part of the switch body protrude from the end cap housing when the switch is in the off-position.

4. The end cap of claim 3, wherein the first spring pushes the end part of the switch body when the switch is in the off-position.

5. An end cap for a light-emitting-diode light tube, the end cap comprising:

an end cap housing having an end surface;

an electric circuit; and a switch for closing the electric circuit or opening the electric circuit, wherein:

the switch comprises:

a switch body having a pivot axis; and a first spring, the switch body is configured to pivotally move, with respect to the pivot axis, between an on-position for closing the electric circuit and an off-position for opening the electric circuit, when the switch is in the off-position, an end part of the switch body protrudes from the end surface of the end cap housing, when the switch is in the on-position, an outer surface of the switch body is substantially flush with respect to the end surface, the first spring is configured to make the end part of the switch body protrude from the end cap housing when the switch is in the off-position, and the first spring pulls another end part of the switch body when the switch is in the off-position so that the end part of the switch body protrudes from the end surface of the end cap housing.

6. The end cap of claim 3, wherein:

the switch further includes:

a extension member extending from the switch body; and an arm member that is a part of the electrical circuit, the extension member is configured to move the arm member to close or to open the electrical circuit.

7. The end cap of claim 6, wherein:

the switch further includes a contact part, the arm member has a curved portion and a contact portion, when the switch is in the on-position, the extension member is configured to make the contact portion of the arm member to contact the contact part so as to close the electrical circuit, and when the switch is in the off-position, the extension member is configured to make the contact portion of the arm member to be detached from the contact part so as to open the electrical circuit.

8. The end cap of claim 7, wherein:

the extension member includes:

a stud; and a second spring elastically connecting the extension member and the stud, and an end of the stud is configured to slide on the curved portion of the arm member.

9. The end cap of claim 7, wherein:

the end cap further comprises a pin for receiving electric power, the pin protruding from the end cap housing, and the pin is connected the electric circuit.

10. The end cap of claim 9, wherein the pin includes two pins.

11. The end cap of claim 1, wherein:

the end cap further comprises a switch housing for enclosing the switch.

12. The end cap of claim 3, wherein:

the end cap further comprises a switch housing for enclosing the switch.

13. The end cap of claim 5, wherein:

the end cap further comprises a switch housing for enclosing the switch.

14. The end cap of claim 7, wherein:

the end cap further comprises a switch housing for enclosing the switch.

15. The end cap of claim 8, wherein:

the end cap further comprises a switch housing for enclosing the switch.

16. The end cap of claim 11, wherein:

the switch housing has clip-on retainers, and the switch housing is retained to the end cap housing by the clip-on retainers.

17. The end cap of claim 16, wherein the switch housing is hermetically sealed.

18. The end cap of claim 12, wherein:

the switch housing has clip-on retainers, and the switch housing is retained to the end cap housing by the clip-on retainers.

19. The end cap of claim 18, wherein the switch housing is hermetically sealed.

20. The end cap of claim 13, wherein:

the switch housing has clip-on retainers, and the switch housing is retained to the end cap housing by the clip-on retainers.

21. The end cap of claim 20, wherein the switch housing is hermetically sealed.

22. The end cap of claim 14, wherein:

the switch housing has clip-on retainers, and the switch housing is retained to the end cap housing by the clip-on retainers.

23. The end cap of claim 22, wherein the switch housing is hermetically sealed.

24. The end cap of claim 15, wherein:

the switch housing has clip-on retainers, and the switch housing is retained to the end cap housing by the clip-on retainers.

25. The end cap of claim 24, wherein the switch housing is hermetically sealed.

26. An light-emitting-diode (LED) light tube, comprising:

an LED light tube member on which a plurality of light emitting diodes are disposed; and the end cap according to claim 1, the end cap being disposed at an end of the LED light tube member.

27. The LED light tube of claim 26, wherein:

the switch is in the on-position when the LED light tube is inserted into a socket, and the switch is in the off-position when the LED light tube is removed from the socket.

28. The LED light tube of claim 26, wherein the end part of the switch body is configured to be pressed into the end cap housing by the socket when the LED light tube is being inserted into the socket so that the switch body becomes substantially flush with respect to the end surface.

* * * * *